United States Patent [19]

Porter et al.

[11] 4,325,802

[45] Apr. 20, 1982

[54] METHOD OF LIQUEFACTION OF CARBONACEOUS MATERIALS

[75] Inventors: Clifford R. Porter, Arvada, Colo.; Herbert D. Kaesz, Los Angeles, Calif.

[73] Assignee: Pentanyl Technologies, Inc., Arvada, Colo.

[21] Appl. No.: 207,714

[22] Filed: Nov. 17, 1980

[51] Int. Cl.[3] ..... C10G 1/06; C10G 17/00; C10B 43/00

[52] U.S. Cl. ..... 208/10; 208/108; 201/2.5

[58] Field of Search ..... 201/2.5; 208/10, 108

[56] References Cited

U.S. PATENT DOCUMENTS

| | | | |
|---|---|---|---|
| 1,138,201 | 5/1915 | Ellis | 208/108 X |
| 2,756,194 | 7/1956 | Mayland | 208/10 |
| 3,938,966 | 2/1976 | Kindig et al. | 44/1 C X |
| 4,098,584 | 7/1978 | Kindig et al. | 201/17 X |
| 4,119,410 | 10/1978 | Kindig et al. | 201/17 X |
| 4,120,665 | 10/1978 | Kindig et al. | 201/17 X |
| 4,146,367 | 3/1979 | Hsu | 201/17 X |
| 4,152,247 | 5/1979 | Antoc | 208/108 X |
| 4,175,924 | 11/1979 | Kindig et al. | 44/1 SR |
| 4,273,643 | 6/1981 | Bennett | 201/2.5 X |

FOREIGN PATENT DOCUMENTS

| | | | |
|---|---|---|---|
| 535746 | 1/1957 | Canada | 208/10 |

OTHER PUBLICATIONS

"From Agricultural Wastes to Feed or Fuel", Chem & Engineering News May 29, 1972, pp. 14–15.

*Primary Examiner*—Delbert E. Gantz
*Assistant Examiner*—William G. Wright
*Attorney, Agent, or Firm*—Sheridan, Ross & McIntosh

[57] ABSTRACT

Hydrocarbon liquids are obtained from carbonaceous materials, such as coal, by contacting the carbonaceous materials with a metal carbonyl or a low valent complex of the transition metals and water gas under alkaline conditions to form a reaction mixture, and then heating the reaction mixture to a sufficent temperature and pressure to obtain the hydrocarbon liquids.

37 Claims, No Drawings

METHOD OF LIQUEFACTION OF CARBONACEOUS MATERIALS

BACKGROUND AND SUMMARY OF THE INVENTION

The present invention relates to the liquefaction of carbonaceous materials, and more particularly to a method for the structural degradation and/or hydrogenation of carbonaceous material with a metal carbonyl or a low valent complex of the transition metals under alkaline conditions in the presence of water gas to form liquid products.

With the present world wide emphasis on the energy crisis and increasingly diminishing supplies of readily produceable, naturally occuring petroleum oil and gas reserves, increased attention by both governmental and private organizations is being given alternate energy sources.

Due to the vast resources of coal and other carbonaceous materials available for development in the United States and other countries, it appears that these resources will play an important role in energy supply for the future. However, a significant proportion of the world's coal supply contains a relatively large amount of heteroatoms, such as sulfur and nitrogen, which lead to air pollution and handling problems upon utilization of the raw coal as an energy source. For this reason, processes for obtaining a clean fuel from raw coal are becoming increasingly attractive.

Several processes are known in the art for beneficiating solid carbonaceous materials, such as coal, to reduce impurities. For example, U.S. Pat. Nos. 3,938,966; 4,098,584; 4,119,410; 4,120,665; 4,146,367; and 4,175,924 relate to such processes.

In addition to the use of beneficiated coal, considerable attention has been given to processes for the gasification of liquefaction of coal to produce petroleum-like oils and gaseous products. Coal liquefaction processes exhibit an advantage over coal gasification processes in that the liquid products of a coal liquefaction process generally have higher energy densities, resulting in mining transportation, storage and utilization savings. Thus, there exits an urgente need for the development of liquefaction processes which are capable of providing liquid fuel products in an economical manner.

The essence of a coal liquefaction process is the structural degradation of, and/or the addition of hydrogen to, a carbonaceous material, with heteroatom removal being an important consideration. In theory, for example, an increase in the hydrogen content of coal of about 2 to 3 percent may result in the production of heavy oils, while an increase in the hydrogen content of coal of about 6 percent or more may result in the production of light oils and gasoline. Present methods for the liquefaction of coal generally include pyrolysis, solvent extraction, direct hydrogenation and indirect hydrogenation. Pyrolysis processes are frequently unattractive due to the high energy inputs required to thermally break down the coal molecule. Solvent extraction utilizes a hydrogen donor solvent system which generally requires a separate step and facilities for catalytic hydrogenation of the solvent system. Indirect liquefaction generally involved reacting coal with steam and oxygen at high temperature to produce gas consisting primarily of hydrogen, carbon monoxide and methane, and then catalytically reacting the hydrogen and carbon monoxide to synthesize hydrocarbon liquids by the Fischer-Tropsch process. Indirect liquefaction processes therefore involve multiple process steps requiring relatively large energy inputs and expensive process facilities. Direct liquefaction processes typically involve the hydrogenation of coal particles with a solid catalyst, such as on a fixed bed catalyst or an ebullated bed catalyst. The use of solid catalyst systems has resulted in additional problems, since it is difficult to obtain contact between the solid phases of the coal and catalyst, and solid catalytic processes frequently suffer from catalyst poisoning.

As can be seen from the foregoing, there are many problems associated with the production of hydrocarbon liquids from solid carbonaceous materials, including the need for expensive high pressure and temperature equipment, relatively low yields which are obtained under economically feasible temperature and pressure conditions, catalyst losses, and the like. However, one of the largest problems hindering commercial development of coal liquefaction processes is economic, due principally to the high cost of hydrogen and capital costs associated with high pressure and temperature equipment. In current practices, the main source of hydrogen is from hydrocarbons, including natural gas, LPG, naptha, etc. Regardless of the source, the high cost of hydrogen presently makes coal liquefaction economically prohibitive, even in relationship to the high cost of natural crude oil.

In order to overcome the foregoing problem, it has been suggested that the hydrogen requirements for a coal liquefaction process could be obtained from the water gas shift reaction by reacting carbon monoxide and water (i.e., water gas) to form hydrogen and carbon dioxide. Previously suggested catalysts for this reaction in connection with coal liquefaction processes have been primarily solid catalysts such as metal oxides, metal chlorides, metal sulfides and the like, and various combinations of these catalysts. However, these processes have been found to require relatively high temperature and pressures, and to suffer from catalyst poisoning and relatively low yields.

It has now been found that hydrocarbon liquids can be obtained in relatively high yields from carbonaceous materials by contacting the carbonaceous materials with a liquefaction facilitating agent, such as a metal carbonyl or a low valent complex of the transition metals, and water gas under alkaline conditions to form a reaction mixture, and then heating the reaction mixture to a sufficient temperature and pressure to obtain the hydrocarbon liquids. Treatment according to the present invention can additionally result in the reduction or removal of sulfur, nitrogen and similar heteroatoms, thereby providing a clean burning liquid fuel energy source.

DESCRIPTION OF ILLUSTRATIVE EMBODIMENTS

As used herein, the term "carbonaceous material" includes solid, semi-solid and liquid organic materials which are susceptible to the treatment method. Examples of solid carbonaceous materials which may be used in connection with the practice of the invention include coal, such as anthracite, bituminous, sub-bituminous and lignite coals, as well as other solid carbonaceous materials, such as wood, lignin, peat, solid petroleum residuals, solid carbonaceous materials derived from coal, and the like. Examples of semi-solid and liquids carbonaceous materials include coal tars, tar sand, asphalt, shale oil, heavy petroleum oils, light petroleum oils, petroleum residuals, coal derived liquids and the like.

The terms "solvent" and "solvent medium" mean a penetration enhancing or solubilizing medium which may solubilize at least a portion of the carbonaceous material and/or may otherwise enhance liquefaction of the carbonaceous material during practice of the present invention.

The term "liquefaction" means the structural degradation of a carbonaceous material typically, but not necessarily, accompanied by hydrogenation processes or the addition of hydrogen to the molecular structure of the material. Liquefaction according to the present invention may be used to obtain hydrocarbon liquids from solid carbonaceous materials. In addition, hydrocarbon semi-solids and liquids may be further converted, structurally degraded, altered and/or hydrogenated according to the present invention in a manner analogous to the reforming or cracking of liquid hydrocarbons in a hydrocarbon refinery operation. Thus, as used herein, "production or conversion" of hydrocarbon liquids is intended to mean both the production of hydrocarbon liquids and/or gases from solids, the conversion of hydrocarbon solids to other hydrocarbon solids and/or the conversion of semi-solid and liquid hydrocarbons to other liquid hydrocarbons and/or gases.

To facilitate the liquefaction of solid carbonaceous materials, such as coal, it is preferable to comminute the coal prior to treatment according to the method of the present invention. The coal is preferably comminuted to an average top particle size of less than about 40 mesh, more preferably to an average top particle size of less than about 100 mesh and most preferably to an average top particle size of less than about 200 mesh.

In accordance with the present invention, carbonaceous material is contacted with a liquefaction facilitating agent and water gas to form a reaction mixture or slurry. The pH of the reaction mixture or slurry is maintained above about 7.5, preferably within the range of about 7.5 to about 10.7, and the reaction mixture or slurry is heated to a sufficient temperature and pressure to result in the production or conversion of hyrdocarbon liquids, as from hereinbefore defined, from the carbonaceous material. The water gas may be formed by adding water to the reaction mixture or slurry and then heating the reaction mixture in the presence of carbon monoxide, by heating the mixture or slurry in the presence of a steam/carbon monoxide mixture, or by other suitable means. Preferably, the water gas will contain on the order of 2.5 mole of water per mole of carbon monoxide, but other quantities of these components are effective in the practice of the invention. Although not essential, in order to insure maximum hydrocarbon liquid production or conversion, a sufficient amount of water and carbon monoxide are preferably provided to satisfy the hydrogen requirements of the liquefaction method. The reaction mixture or slurry preferably further comprises a solvent medium, as is hereinafter further described.

Suitable liquefaction facilitating agents include metal carbonyls, other low valent complexes of the transition metals, derivatives thereof and mixtures thereof. Examples of suitable metal carbonyls include the transition metal carbonyls of Groups V B, VI B, VII B, and VIII of the periodic system. Specific examples include the carbonyls of vanadium, chromium, manganese, iron, cobalt, nickel, molybdenum, ruthenium, palladium, and tungsten. For purposes of safety and economy, the presently preferred metal carbonyls are iron pentacarbonyl, diiron nonacarbonyl and triiron dodecacarbonyl. Other suitable metal complexes include those containing metal atoms in a chemical form close to that of the metallic state. Specific examples of such low valent complexes include the metallocenes, such as ferrocene, although other low valent metal complexes are useful for this purpose. Suitable derivatives include hydrides of the metal carbonyls and metallocenes, modified hydrides, such as salts of the carbonyl hydrides, and other chemically active derivatives of these compounds. Mixtures of metal carbonyls and/or their derivatives, mixtures of low valent metal complexes and/or their derivatives and mixtures of one or more metal carbonyls and one or more other low valent metal complexes and/or their derivatives are also useful as liquefaction faciliting agents. Methylcyclopentadienyl manganese tricarbonyl is one illustrative example of one mixture useful in the practice of the present invention.

Although the precise reaction mechanism is not completely understood at this time, it is presently believed that under moderately basic reaction conditions, iron pentacarbonyl, for example, is hydrolyzed to iron tetracarbonyl hydride anion and/or iron tetracarbonyl dihydride as follows:

$$Fe(CO)_5 + OH^- \rightleftharpoons HFe(CO)_4^- + CO_2 \quad (1)$$

$$HFe(CO)_4^- + H_2O \rightleftharpoons H_2Fe(CO)_4 + OH^- \quad (2)$$

According to the foregoing reaction scheme, at pH levels less than about 7.5, there may be insufficient hydroxide ion present in the reaction mixture to favor production of iron tetracarbonyl hydride anion according to the reaction of equation (1), above. Similarly, at substantially higher pH levels, for example above about pH 10.7, an excess of hydroxide ions appears to have deleterious effects on the tetracarbonyl hydride shown in equation (1) above.

In order to maintain the reaction mixture or slurry within the desired pH range, it may be necessary to add a suitable base to the aqueous solution. Suitble bases for this purpose include any base which would not have a substantial deleterious effect on the carbonaceous material or the desired reaction conditions. Presently preferred bases include the hyroxides, carbonates and bicarbonates of the alkali metals and the alkaline-earth metals. Specific examples of suitable bases include $NaOH$, $KOH$, $Mg(OH)_2$, $Ca(OH)_2$, $Na_2CO_3$, $K_2CO_3$, $NaHCO_3$, $KHCO_3$, $CaCO_3$, mixtures thereof, and the like, although other bases may be employed for this purpose. When the method of the present invention is used in connection with the treatment at acidic carbonaceous materials, the pH of the reaction mixture or slurry will typically decrease after contact with the carbonaceous material. Therefore, the pH of the reaction mixture or slurry may be maintained in the desired range by carefully controlling the addition of base to the reaction mixture by incorporating suitable pH buffers in the reaction mixture, or by other suitable means.

Although not essential to the treatment method of the invention, it is a presently preferred practice to additionally incorporate a solvent or solvent medium in the reaction mixture or slurry, which may enhance penetration of the liquefaction facilitating agent into the carbonaceous material, may solubilize at least a portion of the carbonaceous material and/or liquefaction facilitating agent, and/or may otherwise enhance liquefaction of the solid carbonaceous material during practice of the present invention. When used, suitable solvents preferably exhibit substantial liquefaction facilitating agent solubility and optimally exhibit substantial water miscibility. Particularly useful solvents have a boiling point in the range of above 30° C., more preferably about 40° C. to about 250° C. and most preferably about 55° C. to about 220° C. Examples of suitable solvents include alkyl alcohols having from one to about six carbon atoms, aromatic hyrocarbons, coal derived liquids, recycle solvents, mixtures thereof and their derivatives. Presently particularly preferred solvents include methanol, ethoxyethanol, tetralin, coal derived liquids, and recycle solvent, although other suitable solvents may be employed. The solvent is preferably incorporated into the reaction mixture in a sufficient amount to solubilize at least a portion of the carbonaceous material and/or the liquefaction facilitating agent. When used in connection with solid carbonaceous materials, additional amounts of solvent may be employed to enhance liquefaction facilitating agent penetration into the solid carbonaceous materials. Preferably the solvent may be incorporated in at least about equal volume with the water in the reaction mixture of slurry, more preferably at least about 2 volumes of solvent are incorporated per volume of water, and most preferably at least about 2.5 volumes of solvent are incorporated per volume of water. A sufficient amount of water must be present in the reaction mixture or slurry to permit the reaction of equation (2), above, to proceed.

The amount of liquefaction facilitating agent required in the reaction mixture or slurry is dependent upon the amount an nature of the solid carbonaceous material to be treated. Generally, it is preferable to employ at least about 250 parts by weight of the agent per million parts of solid carbonaceous material, more preferably at least about 2,500 parts of agent per million parts carbonaceous material, and most preferably at least about 25,000 parts agent per million parts carbonaceous material.

The reaction mixture is heated to a sufficient elevated temperature and pressure to obtain production and/or conversion of hydrocarbon liquids, as hereinbefore defined, from the solid carbonaceous material. For most purposes, it is contemplated that sufficient temperature levels are from about 100° C. to a temperature below the decomposition temperature of the liquefaction facilitating agent under the reaction conditions employed, more preferably from about 110° C. to about 750° C., and most preferably from about 120° C. to about 500° C., at an elevated pressure of at least about 100 p.s.i., more preferably about 200 to about 2,500 p.s.i., and most preferably about 250 to about 1000 p.s.i. It has been found that under the foregoing reaction conditions, relatively short periods of time result in the production of the desired liquids. Although sufficient times are dependent upon the nature of the carbonaceous material, the reduction conditions employed, and the like, for most purposes it is contemplated that reaction times of at least about 1 minute, more preferably from about 2 to about 120 minutes and most preferably from about 5 to about 30 minutes are sufficient to result in the production and/or conversion of hydrocarbon liquids.

After completion of the reaction, a substantial portion of the produced fluids, including gases and easily removable liquids, may be recovered from any remaining solid materials in the reaction mixture, such as by the use of conventional solid/gas and solid liquid separation techniques. Further recovery may additionally be obtained from the remaining solids by such techniques as distillation and/or solvent extraction. The recovered hydrocarbon liquids may then be further treated, such as by filtration, centrifugation, distillation, solvent extraction, magnetic separation, solvent de-ashing, and the like, prior to subsequent utilization of the produced hydrocarbon liquids. Preferably, any remaining solid carbonaceous material and the produced liquids are washed, such as with the solvent, to remove any remaining liquefaction facilitating agent and/or to substantially reduce the sulfate sulfur content of the separated carbonaceous material. In a particularly preferred embodiment, any remaining liquefaction facilitating agent and/or solvent are separated from any remaining solid carbonaceous material or produced liquids and are recycled for reuse in the treatment of additional carbonaceous material.

The foregoing may be further understood in connection with the following illustrative examples.

EXAMPLE I

Coal obtained from the No. 6 Seam, Ohio is pre-processed in a conventional gravity separation, screening and drying process, and is then pulverized to a top particle size of 40 mesh. A 300 cc. Magnedrive autoclave, manufactured by Autoclave Engineers, Eric, Pa., is charged with 50 g. of pulverized coal, 75 g. of methanol and 25 g. of water. The autoclave is sealed and pressure tested, and then charged with 390 p.s.i.g. of carbon monoxide. The reaction mixture is heated to a temperature of 140° to 150° C. for a reaction period of two hours. At the reaction temperature, the pressure in the autoclave is observed to be in the range of 556 to 580 p.s.i.g. Upon termination of the reaction period, the heater jacket is removed from the autoclave and the autoclave is rapidly cooled using forced air convection. A gas sample is then removed from the autoclave and analyzed with a Carle Model 11H refinery gas analyzer. The solid and liquid components are removed from the autoclave and separated by centrifugation.

The foregoing procedure is repeated except with the addition of 2.5 g. of iron pentacarbonyl and 12.5 g. of potassium hydroxide to the reaction mixture.

The reaction yield is estimated by extracting the solid and liquid products with tetrahydrofuran (THF) from the following equation:

$$Y = 100 - \frac{O_{THF} \times A_C \times 100}{A_{THF} \times (100 - A_C)}$$

where:

Y=MAF yield (moisture and ash-free yield)

$O_{THF}$=weight of organics in the THF insolubles $A_{THF}$=weight of ash in the THF insolubles $A_C$=percentage of ash in the coal by weight The results of the solid and liquid product analysis is shown in the following Table I, and the results of the gas sample analysis is shown in Table II:

TABLE I

| | % by Weight | |
|---|---|---|
| | Without Added $Fe(CO)_5$ and KOH | With Added $Fe(CO)_5$ and KOH |
| MAF yield | 0 | 6.9 |

TABLE I-continued

| | % by Weight | |
|---|---|---|
| | Without Added $Fe(CO)_5$ and KOH | With Added $Fe(CO)_5$ and KOH |
| THF Solubles Sulfur | Trace | Trace |

TABLE II

| | Mole % | |
|---|---|---|
| Component | Without Added $Fe(CO)_5$ and KOH | With Added $Fe(CO)_5$ and KOH |
| $H_2$ | 0.9 | 53.9 |
| CO | 97.5 | 36.4 |
| $CO_2$ | 1.0 | 9.5 |
| $CH_4$ | 0.5 | 0.2 |
| $H_2S$ | 0.1 | N.A. |

In addition to the foregoing, it is noted that where iron pentacarbonyl and potassium hydroxide are not added to the reaction mixture, the separated produced liquids are lightly colored yellow and the separated solids have the appearance of the feed coal. Where iron pentacarbonyl and potassium hydroxide are added to the reaction mixture, the produced liquids are black and contain finely dispersed carbonaceous particles, while the separated solids have the appearance of being comminuted by the treatment process.

EXAMPLE II

The foregoing procedure is repeated using 50 g. of pulverized coal, 90 g. of tetralin and 10 g. of water in the reaction mixture and then charging the autoclave with 890 p.s.i.g. of carbon monoxide. The reaction mixture is heated to a temperature of 395°-405° C. for a period of two hours. At the reaction temperature, the pressure in the autoclave is observed to be within the range of 2450 to 2520 p.s.i.g.

This reaction is repeated with the addition of 2.5 g. iron pentacarbonyl and 12.5 g. potassium hydroxide to the reaction mixture. The solid and liquid analysis of these runs is shown in the following Table III, and the gas sample analysis of these runs is shown in Table IV:

TABLE III

| | % by Weight | |
|---|---|---|
| | Without Added $Fe(CO)_5$ and KOH | With Added $Fe(CO)_5$ and KOH |
| MAF conversion | 92.5 | 93.3 |
| THF Solubles Sulfur | 0.15 | 0.06 |

TABLE IV

| | Mole % | |
|---|---|---|
| Component | Without Added $Fe(CO)_5$ and KOH | With Added $Fe(CO)_5$ and KOH |
| $H_2$ | 19.34 | 37.16 |
| CO | 55.92 | 33.91 |
| $CO_2$ | 17.60 | 22.06 |
| $CH_4$ | 4.55 | 4.61 |
| $C_2H_6$ | 1.19 | 1.12 |
| $C_3H_6$ | 0.08 | 0.12 |
| $C_3H_8$ | 0.49 | 0.78 |
| i-$C_4$ | 0.02 | 0.10 |
| n-$C_4$ | 0.06 | 0.12 |
| $H_2S$ | 0.77 | N.A. |

When the reaction is carried out without added iron pentacarbonyl and potassium hydroxide, the reaction products are a heavy black tar. With added iron pentacarbonyl and potassium hydroxide, however, the reaction products are a free flowing liquid at room temperature having the odor of light hydrocarbons.

EXAMPLE III

The foregoing procedure is repeated using 50 g. of pulverized coal, 90 g. of tetralin and 10 g. of water in the reaction mixture and then charging the autoclave with 800 p.s.i.g. of carbon monoxide. The reaction mixture is heated to a temperature of 400° to 410° C. for a period of 10 minutes. At the reaction temperature, the pressure in the autoclave is observed to be within the range of 2440 to 2580 p.s.i.g.

This reaction is repeated with the addition of 2.5 g. of iron pentacarbonyl and 12.5 g. of potassium hydroxide to the reaction mixture. The solid and liquid analysis of these runs is shown in the following Table V and the gas sample analysis is shown in Table VI:

TABLE V

| | % by Weight | |
|---|---|---|
| | Without Added $Fe(CO)_5$ and KOH | With Added $Fe(CO)_5$ and KOH |
| MAF conversion | 81.3 | 82.2 |
| THF Solubles Sulfur | 0.17 | 0.08 |

TABLE VI

| | Mole % | |
|---|---|---|
| Component | Without Added $Fe(CO)_5$ and KOH | With Added $Fe(CO)_5$ and KOH |
| $H_2$ | 7.13 | 35.31 |
| CO | 83.43 | 40.78 |
| $CO_2$ | 6.19 | 15.28 |
| $CH_4$ | 1.60 | 6.28 |
| $C_2H_4$ | 0.30 | 0.32 |
| $C_2H_6$ | 0.69 | 1.39 |
| $C_3H_6$ | 0.05 | 0.08 |
| $C_3H_8$ | 0.17 | 0.51 |
| i-$C_4$ | Trace | 0.01 |
| n-$C_4$ | 0.02 | 0.03 |
| $H_2S$ | 0.37 | N.A. |

The reaction products obtained in the absence of added iron pentacarbonyl and potassium hydroxide are a heavy black tar with a granular appearance, while those obtained in the presence of added iron carbonyl and potassium hydroxide are a smooth gelatinous tar covered by a layer of light oil.

EXAMPLE IV

The foregoing procedure is repeated in a first run (Run 1) using 50 g. of pulverized coal, 75 g. of methanol, 25 g. of water, 2.5 g. of iron pentacarbonyl and 12.5 g. of potassium hydroxide in the reaction mixture, and then charging the autoclave with 312 p.s.i.g. of carbon monoxide. The reaction mixture is heated to a temperature of 225° to 230° C. for two hours. At the reaction temperature, the pressure in the autoclave is observed to be 490 to 525 p.s.i.g.

The foregoing procedure is repeated in a second and third run (Runs 2 and 3), conducted in a 1000 cc autoclave, using 50 g. of pulverized coal, 150 g. of methanol, 52 g. of water, and 12.5 g. of potassium hydroxide in the reaction mixture. The reaction mixture of Run 2 also contains 2.5 g. of iron pentacarbonyl. The autoclave is charged with 550 p.s.i.g. of carbon monoxide and each reaction mixture is heated to a temperature of 230° C. for a period of two hours. At the reaction temperature, the pressure in the autoclave for Runs 2 and 3 is observed to be 1130 to 1280 p.s.i.g. and 1025 to 1100 p.s.i.g., respectively. At periodic intervals, approximately 3 ml. thief samples are taken from the reaction mixture of Runs 2 and 3, and are analyzed for hydrogen to carbon ratio of the THF soluble, pentane insoluble, fraction (H/C) of the samples.

The solid and liquid analysis of these runs is shown in the following Table VII, the gas sample analysis results are shown in Table VIII, and the hydrogen to carbon atomic ratios of the THF soluble, pentane insoluble, fractions of samples from Runs 2 to 3 are shown in Table IX:

TABLE VII

| | | Wt. % | | |
|---|---|---|---|---|
| | | Run 1 | Run 2 | Run 3 |
| MAF | Conversion | 28.82 | 30.8 | 22.4 |
| | Preasphaltines | 3.41 | | |
| | Asphaltines | 4.10 | | |
| | Oil | 21.31 | | |
| THF | Insolubles Ash | 16.28 | | |

TABLE VIII

| | Mole % | | |
|---|---|---|---|
| Component | Run 1 | Run 2 | Run 3 |
| $H_2$ | 4.98 | 30.82 | 2.58 |
| CO | 90.42 | 55.21 | 94.49 |
| $CO_2$ | 4.40 | 13.66 | 2.93 |
| $CH_4$ | 0.14 | 0.27 | |
| $H_2S$ | 0.06 | | |

TABLE IX

| Time From | H/C | |
|---|---|---|
| Start (min.) | Run 2 | Run 3 |
| 15 | 0.84 | 0.62 |
| 30 | | 0.76 |
| 60 | 0.87 | 0.82 |
| 120 | 0.90 | 0.83 |

The feed coal is found to have a hydrogen to carbon atomic ratio of 0.84. The reaction products of Run 3 are noted after air drying to have the appearance of an amorphous filter cake. The products of Run 1 have the appearance of a heavy tar covered by a light oil, while those of Run 2 have the appearance of a heavy tar covered by a heavier oil. The hydrogen to carbon ratio of the THF soluble fraction of the products of Run 1 is found to be 1.53, and the nitrogen content of that fraction is found to be 0.8 percent as compared to 1.34 percent in the feed coal.

The invention has heretofore been described in connection with various presently preferred, illustrative embodiments. Various modifications may be apparent from this description. Any such modificatins are intended to be within the scope of the appended claims, except insofar as precluded by the prior art.

What is claimed is:

1. A method of producing or converting hydrocarbon liquids from carbonaceous materials, comprising:
   contacting the carbonaceous material with a liquefaction facilitating agent selected from the group consisting of metal carbonyls, other low valent metal complexes of the transition metals, derivatives thereof, and mixtures thereof, and water gas to form a reaction mixture,
   maintaining the pH of the reaction mixture greater than about 7.5, and
   heating the reaction mixture to a sufficient temperature and pressure to obtain liquids from the carbonaceous material.

2. The method of claim 1 wherein the carbonaceous material is a solid carbonaceous material.

3. The method of claim 2 wherein the solid carbonaceous material is selected from the group consisting of coal, wood, lignin, peat, and solid petroleum residuals.

4. The method of claim 2 wherein the solid carbonaceous material is coal.

5. The method of claim 4 wherein the coal is selected from the group consisting of anthracite coal, bituminous coal, sub-bituminous coal, and lignite coal.

6. The method of claim 1 wherein the carbonaceous material is a semi-solid or liquid carbonaceous material.

7. The method of claim 6 wherein the carbonaceous material is selected from the group consisting of coal tars, tar sand, asphalt, shale oil, heavy petroleum oils, light petroleum oils, petroleum residuals and coal derived liquids.

8. The method of claim 1 wherein the liquefaction facilitating agent comprises a metal carbonyl selected from the group consisting of vanadium carbonyl, chromium carbonyl, manganese carbonyl, iron carbonyl, cobalt carbonyl, nickel carbonyl, molybdenum carbonyl, ruthenium carbonyl, palladium carbonyl, tungsten carbonyl, derivatives thereof, and mixtures thereof.

9. The method of claim 8 wherein the metal carbonyl comprises an iron carbonyl selected from the group consisting of iron pentacarbonyl, diiron noncarbonyl, triiron dodecacarbonyl, derivatives thereof and mixtures thereof.

10. The method of claim 1 wherein the liquefaction facilitating agent comprises a low valent metal complex selected from the group consisting of the metalocenes, derivatives thereof, and mixtures thereof.

11. The method of claim 10 wherein the metalocene is selected from the group consisting of ferrocene, derivatives thereof and mixtures thereof.

12. The method of claim 1 wherein the reaction mixture further comprises a solvent.

13. The method of claim 1 wherein the pH of the reaction mixture is maintained within the range of about 7.5 to about 10.7.

14. The method of claim 1 wherein the water gas comprises about 2.5 moles of water per mole of carbon monoxide.

15. The method of claim 1 wherein the reaction mixture comprises at least about 250 parts by weight of the liquefaction facilitating agent per million parts of carbonaceous material.

16. The method of claim 15 wherein the reaction mixture comprises at least about 2,500 parts of agent per million parts of carbonaceous material.

17. The method of claim 1 wherein the reaction mixture is heated to a temperature of about 100° C. to a temperature below the decomposition temperature of the liquefaction facilitating agent.

18. The method of claim 17 wherein the reaction mixture is heated to a temperature of about 110° C. to about 750° C.

19. The method of claim 18 wherein the reaction mixture is heated to a temperature of about 120° C. to about 500° C.

20. The method of claim 1 wherein the pressure at the reaction temperature is at least about 100 p.s.i.

21. The method of claim 1 wherein the pressure at the reaction temperature is about 200 to about 2,500 p.s.i.

Best Available Copy

22. The method of claim 1 wherein the pressure at the reaction temperature is about 250 to about 1000 p.s.i.

23. The method of claim 1 wherein the reaction mixture is heated for at least about 1 minute.

24. The method of claim 1 wherein the reaction mixture is heated for about 2 to about 120 minutes.

25. The method of claim 1 wherein the reaction mixture is heated for about 5 to about 30 minutes.

26. The method of claim 1 wherein the pH of the reaction mixture is maintained by adding to the reaction mixture a base selected from the group consisting of the hydroxides, carbonates, bicarbonates and mixtures thereof of the alkali metals and the alkaline earth metals.

27. The method of claim 26 wherein the base is sodium hydroxide.

28. The method of claim 26 wherein the base is potassium hydroxide.

29. The method of claim 26 wherein the base is calcium hydroxide.

30. The method of claim 26 wherein the base is sodium carbonate.

31. The method of claim 26 wherein the base is sodium bicarbonate.

32. The method of claim 26 wherein the base is potassium carbonate.

33. The method of claim 26 wherein the base is potassium bicarbonate.

34. The method of claim 26 wherein the base is calcium carbonate.

35. The method of claim 1 wherein the reaction mixture is heated to a sufficient temperature and pressure to increase the hydrogen to carbon ratio of the carbonaceous material.

36. The method of claim 1 wherein the reaction mixture is heated to a sufficient temperature and pressure to reduce the sulphur content of the carbonaceous material.

37. The method of claim 1 wherein the reaction mixture is heated to a sufficient temperature and pressure to reduce the nitrogen content of the carbonaceous material.

* * * * *